US007946238B2

(12) United States Patent
Colsher et al.

(10) Patent No.: US 7,946,238 B2
(45) Date of Patent: May 24, 2011

(54) ENSURING INSTALLATION OF DRAIN PLUG WHEN LAUNCHING AQUATIC VESSEL

(75) Inventors: Steven J. Colsher, Lansdale, PA (US); Raymond G. Haber, Ambler, PA (US)

(73) Assignee: Safe Launch LLC, Lansdale, PA (US)

( * ) Notice: Subject to any disclaimer, the term of this patent is extended or adjusted under 35 U.S.C. 154(b) by 157 days.

(21) Appl. No.: 12/419,024

(22) Filed: Apr. 6, 2009

(65) Prior Publication Data

US 2009/0260557 A1 Oct. 22, 2009

Related U.S. Application Data

(60) Provisional application No. 61/124,284, filed on Apr. 16, 2008.

(51) Int. Cl.
*B63B 13/00* (2006.01)

(52) U.S. Cl. ..... 114/197
(58) Field of Classification Search ..... 114/197, 114/198; 116/28 R
See application file for complete search history.

(56) References Cited

U.S. PATENT DOCUMENTS 4,516,515 A * 5/1985 Johnson ..... 114/197
6,227,132 B1 * 5/2001 Garcia ..... 114/197
6,755,704 B1 * 6/2004 Leinonen ..... 440/88 L

* cited by examiner

*Primary Examiner* — Lars A Olson
(74) *Attorney, Agent, or Firm* — Howson & Howson LLP

(57) ABSTRACT

An auxiliary strap, connected to a tie-down strap for securing a boat to a trailer, is removably anchored to a drain opening in the boat, by being connected to a tethered drain plug, or by being connected to a spring clip that extends into the drain opening. The connection of the tie-down strap to the drain opening reminds the boater to reinstall the drain plug before launching the boat.

7 Claims, 3 Drawing Sheets

ENSURING INSTALLATION OF DRAIN PLUG WHEN LAUNCHING AQUATIC VESSEL

CROSS-REFERENCE TO RELATED APPLICATION

This application claims the benefit of our provisional patent application 61/124,284, filed Apr. 16, 2008.

FIELD OF THE INVENTION

This invention relates to boating, and more particularly to an apparatus and method for ensuring that a drain plug is installed in a vessel's drain opening when the vessel is launched after being transported on a trailer to a launch site. The invention is applicable to any of a variety of aquatic vessels, including motorboats, sailboats, personal watercraft (PWC), and other vessels of a size suitable for overland transportation on trailers.

BACKGROUND OF THE INVENTION

Vessels suitable for transportation on trailers are typically provided with one or more drain openings, usually in the transom, at a location below the water line. When the vessel is on the water, its drain openings are closed by plugs, which are typically threaded into the drain openings. When the vessel is removed from the water for transportation on a trailer, the plugs are removed to discharge water accumulated in the hull during use of the vessel, and also to discharge rainwater.

An all too common problem is that, when a vessel is launched from a trailer, the replacement of the drain plug or plugs is overlooked, and the vessel fills with water and sinks. Based on recent insurance studies, it has been determined that, in about 12 percent of cases in which a boat sank while underway, the cause was a missing drain plug, and that the average cost of repairing a boat that has been underwater, even briefly, is around 40 percent of the total value of the boat.

Because of the potentially serious consequences of failure to install drain plugs when launching a vessel, it is desirable to provide a reliable means to remind the boater of the need to install drain plugs before launch. Various approaches addressing the problem have been proposed.

One example is the electrical drain plug warning system described in U.S. Pat. No. 5,966,080, granted Oct. 12, 1999 to Bigsby. The Bigsby warning system utilizes a magnet in the plug and a magnetic sensor in associated with the plug-receiving aperture. The sensor is wired to activate an alarm when the user operates a key switch if the plug is not present in the plug-receiving aperture.

Another example is the drain plug retention system described in U.S. Pat. No. 7,316,195, granted Jan. 8, 2008 to DeHart. In the DeHart drain plug retention system, a drain plug wrench and a flotation device are attached to a key chain. Either the wrench or the flotation device has a plug-retaining feature. Because the key chain is also associated with the boat's ignition key, the boater is reminded to install the plug before operating the boat.

In a third example, described in U.S. Pat. No. 4,516,515, granted on May 14, 1985 to Johnson, a plug retainer, into which a drain plug can be threaded, is secured by mounting screws to the transom of a boat. A tie-down strap for securing the boat to a trailer is connected to a flag which is held in the retainer by the drain plug when the drain plug is threaded into the retainer. To remove the boat from the trailer, it is necessary to release the flag from the plug retainer by rotating the plug.

When the boater rotates the plug to release the flag, he is reminded to install the plug in its drain opening.

A need exists for a simple, reliable, and versatile drain plug reminder that does not require permanent attachment of a plug retainer or similar element to the boat hull.

SUMMARY OF THE INVENTION

A first aspect of the invention is a method of transporting and launching an aquatic vessel having a drain opening and a drain plug insertable into the drain opening. The method comprising the following. First, the aquatic vessel is positioned on a trailer and secured to the trailer by connecting the vessel to the trailer by means of at least one tie-down strap to which a first end of a flexible auxiliary strap is connected. A second end of the auxiliary strap is anchored to the drain opening while the drain plug is not inserted in the drain opening. The vessel is transported on the trailer to a launch site, and released from the trailer by releasing a connection of the tie-down strap from at least one of the vessel and the trailer, and releasing the second end of the flexible auxiliary strap from its anchoring relationship with the drain opening. The drain plug is then inserted into the drain opening, and the vessel is launched at the launch site. The above steps are not necessarily sequential. For example, the second end of the auxiliary strap can be released from its anchoring relationship with the drain opening either before or after the tie-down strap is disconnected from the vessel or from the trailer.

Because the auxiliary strap is connected from to the tie-down strap to the drain opening, the individual who is launching the vessel will necessarily observe the connection of the auxiliary strap from the tie-down strap to the drain opening in the process of releasing the tie-down strap from the vessel or from the trailer. The individual will observe the need to release the anchored relationship of auxiliary strap to the drain opening, and will thus be reminded to replace the drain plug in the drain opening.

Where the drain plug is not anchored to the drain opening, the second end of the flexible auxiliary strap can be connected to an expansible spring clip comprising a spring at a first end of the clip, a pair of opposed, elongated elements extending from the spring toward an opposite end of the spring clip and resiliently urged apart from each other by a force exerted by the spring. These opposed, elongated elements are insertable through the drain opening when pressed toward each other in opposition to the force exerted by the spring. Each elongated element has, at the end of the clip opposite from the spring, a prong extending laterally relative to its direction of elongation. The prongs extend in opposite directions and are engageable with an inside surface of the vessel to secure the spring clip against removal from the drain opening when the opposed elongated elements extend through the drain opening and are not pressed toward each other.

Alternatively, when the drain plug is anchored to the drain opening by a tether extending through the drain opening, the step of anchoring the second end of the flexible auxiliary strap to the drain opening while the drain plug is not inserted in the drain opening is carried out by connecting the second end of the flexible auxiliary strap to the drain plug.

A second aspect of the invention is the combination of an aquatic vessel having an open drain opening closable by a drain plug, and a trailer on which the aquatic vessel is supported for transportation. The combination includes means for securing the vessel to the trailer, including a tie-down strap, connected to the vessel and the trailer, and a flexible auxiliary strap having first and second ends. The first end of the auxiliary strap is connected to the tie-down strap, and the second end is anchored to the open drain opening. If the drain plug is not anchored to the drain opening, the combination can include the above-described spring clip. Alternatively, if the drain plug is anchored to the drain opening, the by a tether extending through the drain opening, the second end of the flexible auxiliary strap is connected to the drain plug.

Preferably, the auxiliary strap is sufficiently short that the vessel cannot be removed from the trailer while the auxiliary strap is intact, the first end of the auxiliary strap is connected to the tie-down strap, and the second end of the auxiliary strap is anchored to the drain opening.

DETAILED DESCRIPTION OF THE PREFERRED EMBODIMENT

Figure 1:
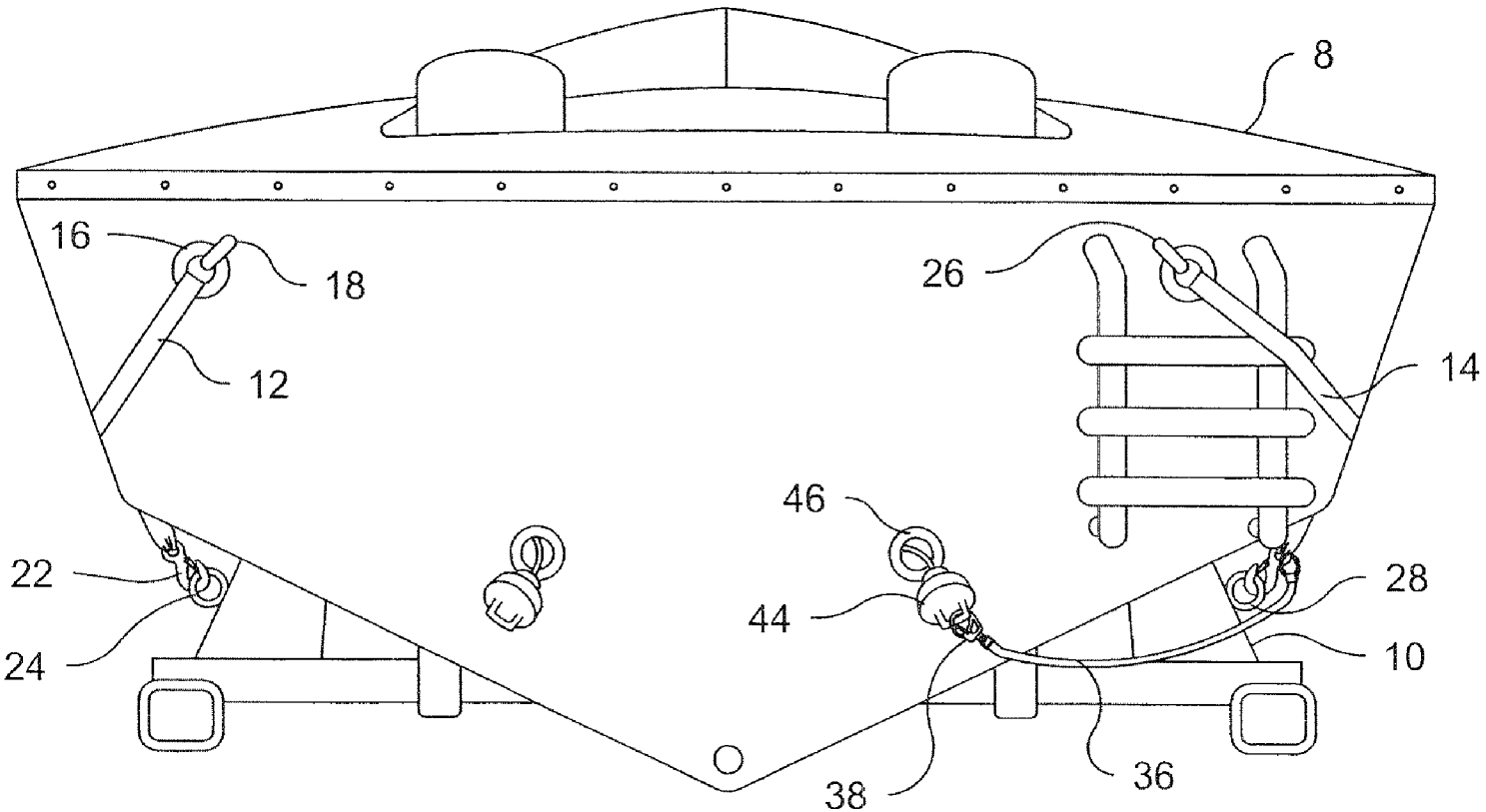
FIG. 1 is a elevational view of the stern of a typical motorboat supported on, and tied down to, a transport trailer, the figure showing a flexible auxiliary strap in accordance with the invention connected from a tie-down strap to a drain plug in accordance with a first embodiment of the invention.

As shown in FIG. 1, an aquatic vessel 8, in this case, a motorboat, is mounted on a trailer 10 for overland transportation. The vessel is secured to the trailer by a set of tie-down straps including straps 12 and 14. The securing means can include additional tie-down straps (not shown) or other suitable connections for holding the vessel on the trailer during transport over land. One end of strap 12 is connected by a snap hook 16 to an eye bolt 18 secured to the outside face of the vessel's transom 20. The opposite end of strap 12 is connected by a snap hook 22 to an eye bolt 24 on the trailer frame. Strap 14 is similarly connected to eye bolt 26 on the transom and eye bolt 28 on the trailer.

Figure 2:
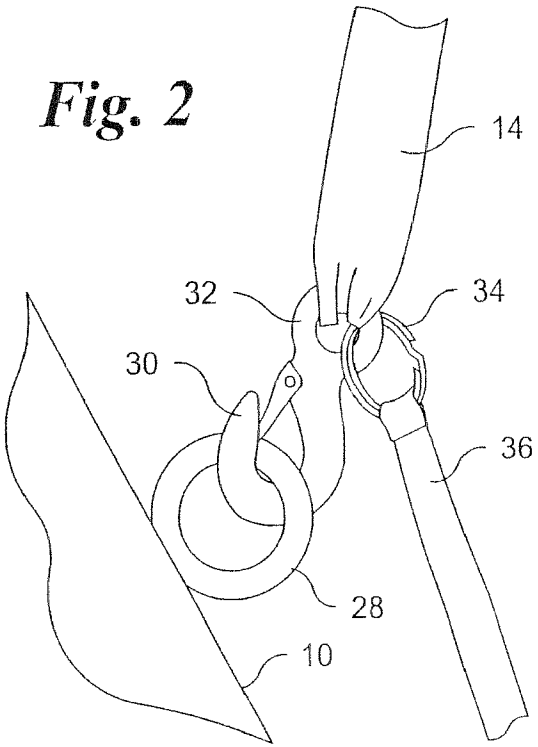
FIG. 2 is a perspective view of the auxiliary strap.

FIG. 2 shows in greater detail, the snap hook 30, secured to an end of tie-down strap 14, and engaged with eye bolt 28 on the trailer 10. The strap 14 is connected to the eye 32 of the snap hook. Connected to the same eye is a split ring 34 secured to one end of an auxiliary strap 36 by looping the strap through the ring, folding the strap over onto itself and sewing the overlapping parts together. The split ring 34 is similar to a conventional key ring, and preferably consists of approximately two turns of spring metal in a helix with the adjacent turns tight contact with each other. The split ring can be made from other materials such as plastics.

The split ring connects the auxiliary strap 36 to the snap hook 30 and to strap 14 in such a way that the auxiliary strap is not readily removable from the strap 14. The connection of the auxiliary strap to the tie-down strap is intended to be a permanent connection.

The auxiliary strap 36 can be made of any of a wide variety of materials and configurations. For example, the strap 36 can be made from a woven polymer such as polyamide (Nylon) fibers or polypropylene fibers, natural fibers such as cotton, or even a metal. It can be a flat weave or in the form of a woven, braided, or twisted cord, or other suitably formed cord having a circular cross-section or any other suitable cross-sectional shape. The strap can even be in the form of a metal wire such as a metal filament or a twisted metal cable. Thus, the term "strap" as used herein is intended to encompass a flat, woven, polymer strap, and any suitable equivalent flexible connecting device. A flat-woven fabric strap is preferred because it lends itself readily to length adjustment by being fed through an adjusting slide. Preferably, the auxiliary strap is a flat woven strap having a width of about ½ inch, a thickness of about 1/16 inch and a length of about 36 inches.

Figure 3:
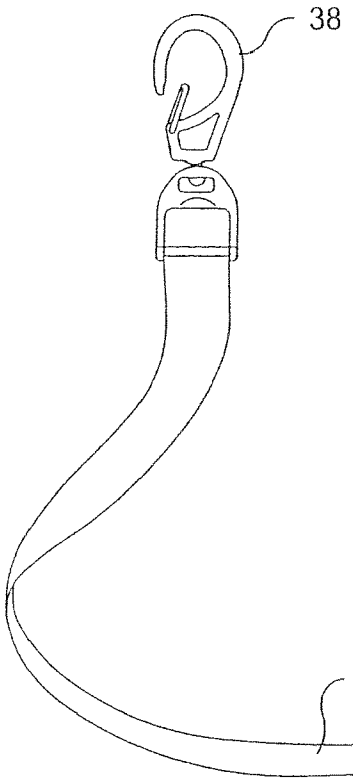
FIG. 3 is a partial perspective view showing details of a connection of the auxiliary strap to a tie-down strap used to secure the boat to the trailer in FIG. 1.

As shown in FIG. 3, the end of the auxiliary strap 36 remote from split ring 34 is provided with a snap-hook 38 connected by a swivel 40 to an adjusting slide 42 on strap 36, by which the effective length of the auxiliary strap, i.e., the distance between ring 34 and snap hook 38, can be adjusted.

Figure 4:
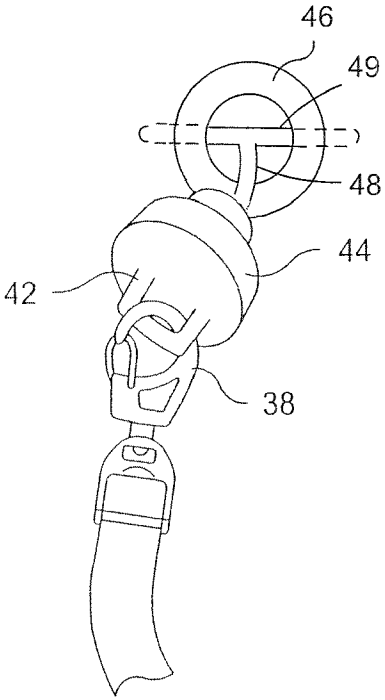
FIG. 4 is a partial perspective view showing details of the connection of the auxiliary strap to the drain plug in FIG. 1.

FIG. 4 shows the snap hook 38 connected to a loop 42 formed on a plug 44 associated with a drain hole 46. This plug 44 is permanently secured to the drain hole by a tether 48, which extends into the drain hole and has a T-shaped end 49, which limits separation of the plug from the drain hole 46 by engagement with a part of the vessel adjacent the inner end of drain hole, thereby preventing it from being completely removed from the drain hole. If the drain plug does not have a loop such as loop 42, the snap hook 38 can be engaged with the tether 48. As seen in FIG. 1, the strap 36 connects the snap hook at the lower end of tie-down strap 14 to the drain plug 44, and its length is adjusted so that the boat cannot be removed from the trailer while the auxiliary strap is connected to the drain hole 46 and to the trailer eye bolt 28. Preferably the strap is adjusted so that it is nearly as short as possible, but still easily connected to the drain plug 44.

When the boat is placed on the trailer, its drain plug or plugs are opened, and the tie-down straps 12 and 14 are connected to the boat and to the trailer as shown in FIG. 1. The tie-down strap 14 already has the auxiliary strap connected at one end to its snap hook 30, and the snap hook at the opposite end of the auxiliary strap is connected to the drain plug 44.

When the boat is to be launched, it is necessary to remove the tie-down strap 14 from the eye bolt 28 on the trailer. Since the auxiliary strap 36 is permanently connected to the tie-down strap by engagement of the split ring 34 with eye 32 on snap hook 30, in order stow the tie-down strap, it is also necessary to remove the auxiliary strap from the drain plug. When removing the auxiliary strap from the drain plug, the boater is reminded to reinstall the drain plug in its drain opening, and also to reinstall any other opened drain plug. Optionally, a second auxiliary strap could be associated with the second drain plug, but the second strap will usually be unnecessary unless the boater has an excessive level of anxiety or an unusually short attention span.

Figure 5:
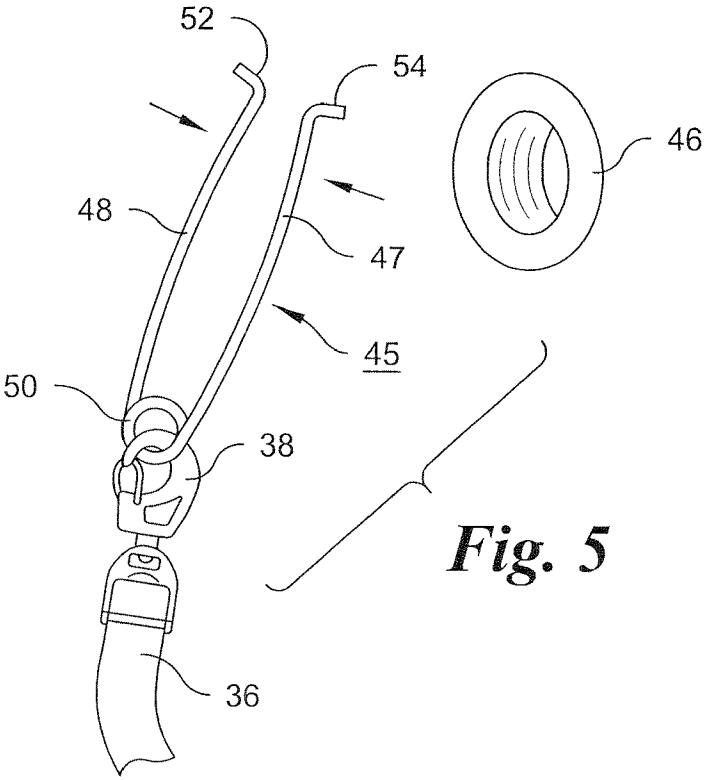
FIG. 5 is partial perspective view showing a flexible clip in accordance with a second embodiment of the invention about to be inserted into a drain opening.

In the case where the drain plug or plugs do not have tethers permanently connecting them to their drain holes, a spring clip 45 can be connected to snap hook 36, as shown in FIG. 5.

Figure 6:
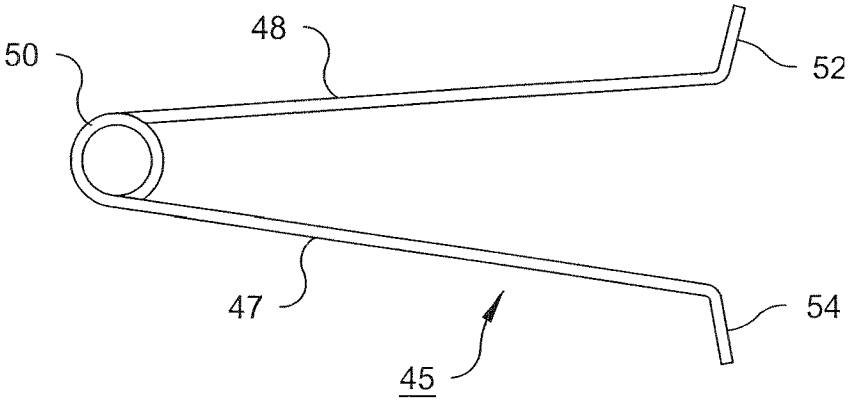
FIG. 6 is an elevational view of the flexible clip.
Figure 7:
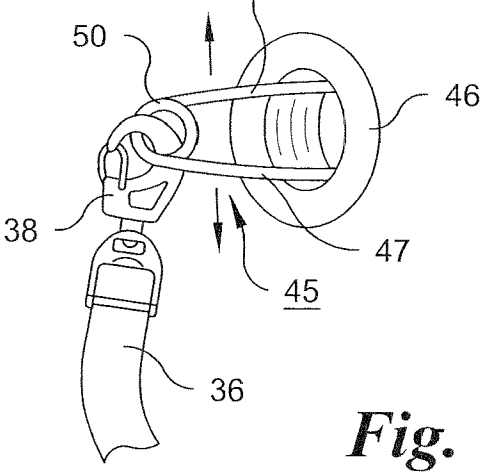
FIG. 7 is a partial perspective view showing the flexible clip inserted in a drain opening.

As seen in FIG. 6, the spring clip is formed from a unitary length of spring wire, preferably a stainless steel, with two legs 47 and 48, connected by a loop or coil 50, which acts as a spring, resiliently urging the legs apart from each other so that they diverge slightly while being situated in a common plane. The ends of the legs remote from the loop 50 have prongs 52 and 54 respectively, which are preferably situated in a common plane with legs 47 and 48, and extend in opposite directions from each other so that they can engage the inner wall of the transom when the clip is inserted through the drain opening as shown in FIG. 7, thereby holding the clip engaged in the drain opening and preventing its removal unless the legs of the clip are pressed toward each other as shown by the arrows in FIG. 5. Loop 50 is preferably about ½ inch in diameter, and legs 47 and 48 are preferably about four inches long. Prongs 52 and 54 are preferably each approximately ½ inch in length, and the distance between the ends of legs 47 and 48 remote from the spring loop 50 is preferably approximately 1⅛ inch when the spring clip is relaxed as shown in FIG. 6.

The spring clip is inserted into a drain opening by pressing its legs toward each other so that its prongs 52 and 54 can clear the drain opening. When the clip is inserted and released, its legs engage the wall of the drain opening and become generally parallel to each other. The prongs 52 and 54 can then engage the inside wall of the transom to hold the spring clip in place.

The spring clip version of the invention functions in substantially the same way as the version shown in FIGS. 1-4. That is, when the boat is placed on the trailer, its drain plug or plugs are opened and stowed, and the tie-down straps are connected to the boat and to the trailer. The spring clip, located at an end of an auxiliary strap the other end of which is permanently connected to one of the tie-down straps is inserted in a drain opening.

When the boat is to be launched, the boater must disconnect the auxiliary strap from the drain opening, preferably by pressing the spring clip legs toward each other and removing the reminded to reinstall the drain plug in its drain opening, and also to reinstall any other opened drain plug.

Many modifications can be made to the invention in addition to those already mentioned. For example, while it is preferable to have the auxiliary strap connected to the snap hook at the trailer end of one of the tie-down straps, the auxiliary strap can be connected to any part of the tie-down strap, and the connection can be made by various means other than the split ring. For example, the auxiliary strap can be sewn to the tie-down strap. The spring clip is preferably attached to a snap hook at an end of the auxiliary strap so that the same auxiliary strap can be used with a boat having a tethered drain plug and with a boat having a completely removable drain plug. However it is possible to provide a permanent connection between the spring clip and the auxiliary strap.

Still other modifications may be made to the apparatus and method described above without departing from the scope of the invention as defined in the following claims.

We claim:

1. A method of transporting and launching an aquatic vessel having a drain opening with inner and outer ends, and a drain plug insertable into the drain opening, the plug being connected to a tether that extends from the plug into the drain opening, the tether including an anchoring part that moves with the tether and limits separation of the plug from the drain opening by engagement with a part of the vessel adjacent the inner end of the drain opening, the method comprising the steps of:

positioning the aquatic vessel on a trailer;

securing the aquatic vessel to the trailer by connecting the vessel to the trailer by means of at least one tie-down strap having a flexible auxiliary strap having first and second ends, the first end being connected to the tie-down strap;

anchoring the second end of the flexible auxiliary strap to the drain opening while the drain plug is not inserted in the drain opening by connecting the second end of the flexible auxiliary strap to the drain plug;

transporting the vessel, on the trailer, to a launch site;

releasing the vessel from the trailer by releasing a connection of the tie-down strap from at least one of the vessel and the trailer, and releasing the second end of the flexible auxiliary strap from its anchoring relationship with the drain opening;

inserting the drain plug in the drain opening; and launching the vessel at the launch site.

2. A method of transporting and launching an aquatic vessel having a drain opening and a drain plug insertable into the drain opening comprising the steps of:

positioning the aquatic vessel on a trailer;

securing the aquatic vessel to the trailer by connecting the vessel to the trailer by means of at least one tie-down strap having a flexible auxiliary strap having first and second ends, the first end being connected to the tie-down strap;

anchoring the second end of the flexible auxiliary strap to the drain opening while the drain plug is not inserted in the drain opening;

transporting the vessel, on the trailer, to a launch site;

releasing the vessel from the trailer by releasing a connection of the tie-down strap from at least one of the vessel and the trailer, and releasing the second end of the flexible auxiliary strap from its anchoring relationship with the drain opening;

inserting the drain plug in the drain opening; and launching the vessel at the launch site;

in which the drain opening extends from an inside surface of the vessel to an outside surface of the vessel, and in which the second end of the flexible auxiliary strap is connected to an expansible spring clip comprising a spring at a first end of the clip, a pair of opposed elongated elements extending from the spring toward an opposite end of the spring clip and resiliently urged apart from each other by a force exerted by the spring, said elements being insertable through the drain opening when pressed toward each other in opposition to the force exerted by the spring, each elongated element having, at its end opposite from the spring, a prong extending laterally relative to its direction of elongation, the prongs extending in opposite directions and being engageable with the inside surface of the vessel to secure the spring clip against removal from the drain opening when the opposed elongated elements extend through the drain opening and are not pressed toward each other.

3. A combination of an aquatic vessel having an open drain opening with inner and outer ends, and a drain plug insertable into the drain opening, the plug being connected to a tether that extends from the plug into the drain opening, the tether including an anchoring part that moves with the tether and limits separation of the plug from the drain opening by engagement with a part of the vessel adjacent the inner end of the drain opening, and a trailer on which the aquatic vessel is supported for transportation, the combination including:

means for securing the vessel to the trailer, said securing means including a tie-down strap, connected to the vessel and the trailer, and a flexible auxiliary strap having first and second ends, the first end being connected to the tie-down strap, and the second end being connected to the drain plug.

4. The combination according to claim 3, in which the anchoring part is a T-shaped end part of the tether.

5. The combination according to claim 3, in which the drain plug is formed with a loop, and in which the second end of the auxiliary strap is connected to the drain plug by engagement of a snap hook on the second end of the auxiliary strap with said loop of formed on the drain plug.

6. A combination of an aquatic vessel having an open drain opening closable by a drain plug, and a trailer on which the aquatic vessel is supported for transportation, the combination including:

means for securing the vessel to the trailer, said securing means including a tie-down strap, connected to the vessel and the trailer, and a flexible auxiliary strap having first and second ends, the first end being connected to the tie-down strap, and the second end being anchored to the open drain opening;

in which the vessel has an inside surface and an outside surface, in which the drain opening has an inner circumferential surface and extends from the inside surface of the vessel to the outside surface of the vessel, and including an expansible spring clip connected to the second end of the flexible auxiliary strap, the expansible spring clip comprising a spring at a first end of the clip, a pair of opposed elongated elements extending from the spring toward an opposite end of the spring clip and resiliently urged apart from each other by a force exerted by the spring, said elements extending through the drain opening and being resiliently urged apart from each other into engagement with the inner circumferential surface of the drain opening by a force exerted by the spring, the spring clip having, at said opposite end, a pair of prongs extending laterally relative to the direction of elongation of said opposed elements, the prongs being engageable with the inside surface of the vessel when the opposed elongated elements of the clip are in engagement with the inner circumferential surface of the drain opening and securing the spring clip against removal from the drain opening, but being sufficiently short that the spring clip can be released from the drain opening by pressing the elongated elements toward each other.

7. The combination according to claim 6, in which the auxiliary strap is sufficiently short that the vessel cannot be removed from the trailer while the auxiliary strap is intact, the first end of the auxiliary strap is connected to the tie-down strap, and the second end of the auxiliary strap is anchored to the drain opening.

* * * * *